US005657647A

United States Patent [19]

Freiesleben

[11] Patent Number: 5,657,647

[45] **Date of Patent: *Aug. 19, 1997**

[54] CUT DIAMOND

[76] Inventor: Ulrich Freiesleben, Handorfer Strasse 34, 48157 Muenster, Germany

[ * ] Notice: The term of this patent shall not extend beyond the expiration date of Pat. No. 5,454,235.

[21] Appl. No.: 506,919

[22] Filed: Jul. 26, 1995

Related U.S. Application Data

[63] Continuation of Ser. No. 157,058, filed as PCT/DE93/00304, Apr. 1, 1993, Pat. No. 5,454,235.

[30] Foreign Application Priority Data

Apr. 2, 1992 [DE] Germany ..... 42 10 995.7

[51] Int. Cl.[6] ..... A44C 17/00

[52] U.S. Cl. ..... 63/32

[58] Field of Search ..... 63/32

[56] References Cited

U.S. PATENT DOCUMENTS

| | | | |
|---|---|---|---|
| D. 36,103 | 10/1902 | St. John Wood | 63/32 |
| D. 36,104 | 10/1902 | St Joh Wood | 63/32 |
| 2,554,901 | 5/1951 | Fromholt | 63/32 |
| 2,587,972 | 3/1952 | Crise | 63/32 |
| 3,796,065 | 3/1974 | Watermeyer | 63/32 |
| 3,835,665 | 9/1974 | Kitchel | 63/32 |
| 4,604,876 | 8/1986 | Hoffmann | 63/32 |
| 4,708,001 | 11/1987 | Alburger . | |
| 5,072,549 | 12/1991 | Johnston . | |
| 5,186,024 | 2/1993 | Waters, Jr. | 63/32 |

FOREIGN PATENT DOCUMENTS

| | | |
|---|---|---|
| 0 084 804 | 1/1983 | European Pat. Off. . |
| 1 557 625 | 2/1972 | Germany . |
| 2 254 321 | 5/1974 | Germany . |

*Primary Examiner*—Michael J. Milano

*Attorney, Agent, or Firm*—Jacobson, Price, Holman & Stern, PLLC

[57] ABSTRACT

A diamond without plate is described, in which the facets of the upper part are more slanted toward the girdle level than the facets of the lower part. To create a diamond that, with the least possible quantity of material, gives one an impression of hardness and clarity when looking down on it, the angle between one of the equally large upper part facets and the preferably polygonal girdle level as well as the angle between one of the equally large lower part facets and the girdle level is chosen in such a way that seen from above, the girdle level appears in essentially homogenous, planar brilliance in which a central, shining star is imbedded.

2 Claims, 4 Drawing Sheets

CUT DIAMOND

This is a continuation of application Ser. No. 08/157,058, filed as PCT/DE93/00304 Apr. 1, 1993, now U.S. Pat. No. 5,454,235.

FIELD OF THE INVENTION

The invention refers to a diamond without plate in which the facets of the upper part are more slanted toward the girdle level than the facets of the lower part.

BACKGROUND OF THE INVENTION

Precious stones of the aforementioned type are known from German patent 1,557,625. Angle a between a facet of the upper part and the girdle level and angle b between a facet of the lower part and the girdle level are always selected in such a way that the diamond displays optimal brilliance seen from above. In this case, brilliance means, according to Roesch: What is a cut diamond? in: Goldschmiedezeitung [Goldsmith's Newspaper], Vol. 12, 1971, P. 39, the sum of surface shine and lower part reflection, whereby the light entering the diamond from the upper part is totally reflected on the facets of the lower part. To give a diamond as much "fire"as possible, i.e., the greatest possible opalescence, 50 plus facets were cut on the upper part in such a way that a large number of partially colored reflections pointing in various directions were obtained, contributing considerably to the appreciation of the diamond.

This consideration does not take into account the fact that a diamond is a precious, rarely occurring stone that came into being millions of years ago in the depths of the earth under extreme conditions, in a shape it kept ever since and displays today. To prepare a diamond in such a way that as a jewel, it spreads as much. fire as possible, does not, if we consider the history of the stone, do justice to its hardness, constancy and clarity as well as the esthetics of the material.

SUMMARY OF THE INVENTION

The task of the invention is therefore to cut a raw diamond in such a way that with the least possible quantity of material, one gets an impression of its hardness and clarity when looking down on it.

For this, according to the invention, in the diamond mentioned in the beginning, the angle between one of the equally large upper part facets and the preferably polygonal girdle level as well as the angle between one of the equally large lower part facets and the girdle level are selected in such a way that seen from above, the girdle level appears in essentially homogenous, planar brilliance in which a central, shining star is imbedded. The areas of planar brilliance create an impression of calm and hardness, quite befitting of the stone considering its age and consistency. The star lighting up in the middle of the girdle level, with its number of rays influenced by the number of corners of the girdle level, occurs as a purely optical phenomenon, i.e., without additional cut surfaces.

According to a preferred form of construction of the invention, from the two culets (points or tips) of the diamond in the upper part as well as in the lower part, roughly eight to sixteen equally large facets go out, whereby each upper part facet encloses an approx. 20.5 degree angle with the girdle level and each lower part facet encloses an approx. 40 degree angle with the girdle level. In the process, the effect of the many-rayed star predominates over that of the areas of planar brilliance when one contemplates the diamond.

The many-rayed quality of the star impression can be increased if the facets of the upper part do not run together at the girdle level at the same angle with the facets of the lower part, but rather they meet each other at the girdle forming a symmetrical off-set structure such that one edge of each upper facet meets the imaginary center line of each lower facet.

According to another form of construction of the invention, the calm and hardness of the stone is particularly accentuated when the girdle level is square and the angle between each of the four upper part facets and the girdle level is chosen at about 24.5 degrees and the angle between each of the lower part facets and the girdle level is chosen at about 39.5 degrees. When observing this stone, a prostrate, shining cross appears on a surface of planar brilliance.

The invention is explained in detail below using the form of construction shown in the attached drawing.

These and other objects of the invention, as well as many of the intended advantages thereof, will become more readily apparent when reference is made to the following description taken in conjunction with the accompanying drawings.

DETAILED DESCRIPTION OF THE DRAWINGS

Figure 1:
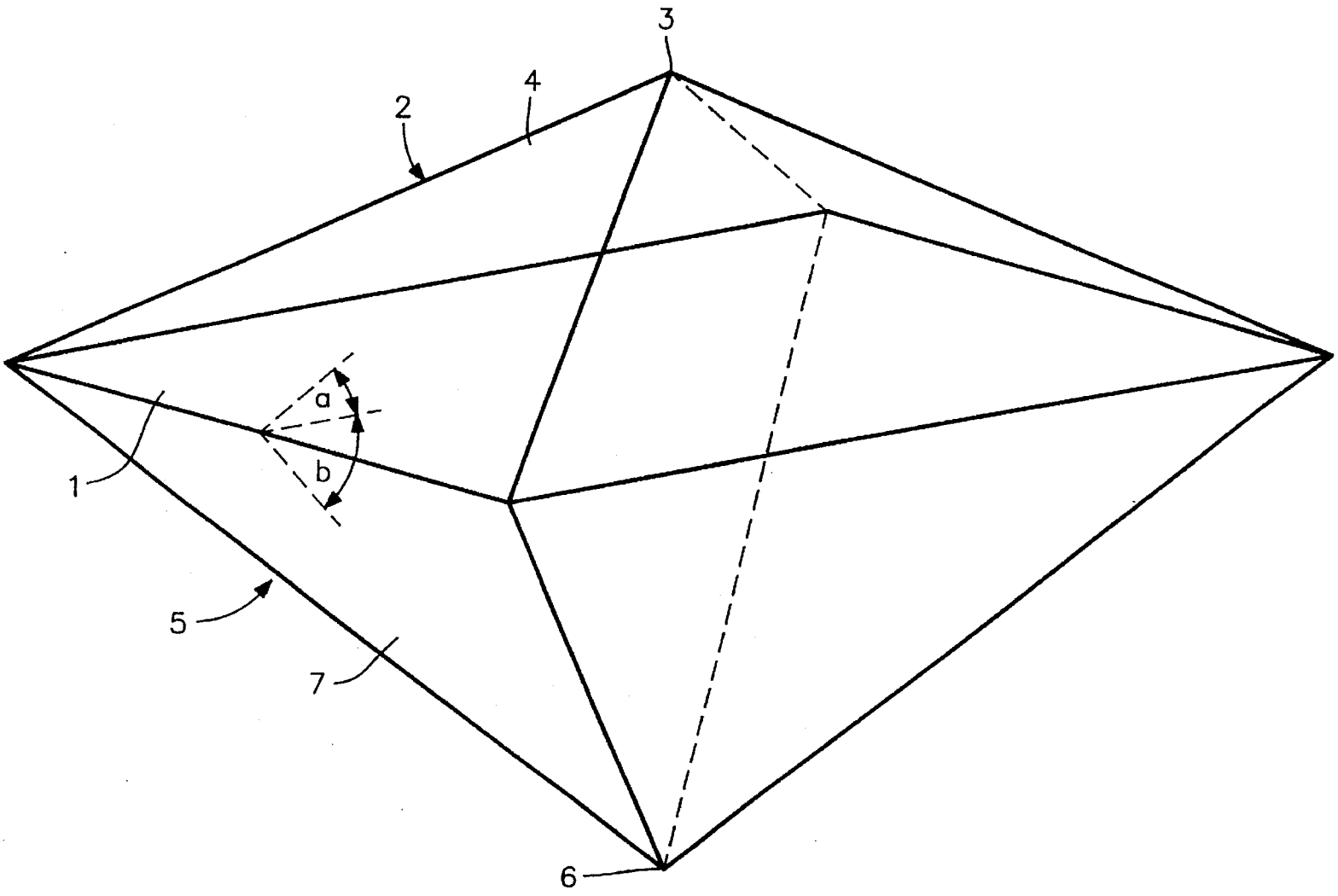
FIG. 1, shows a perspective view of a cut diamond with angles a and b drawn in between an upper part facet and a lower part facet and the girdle level.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
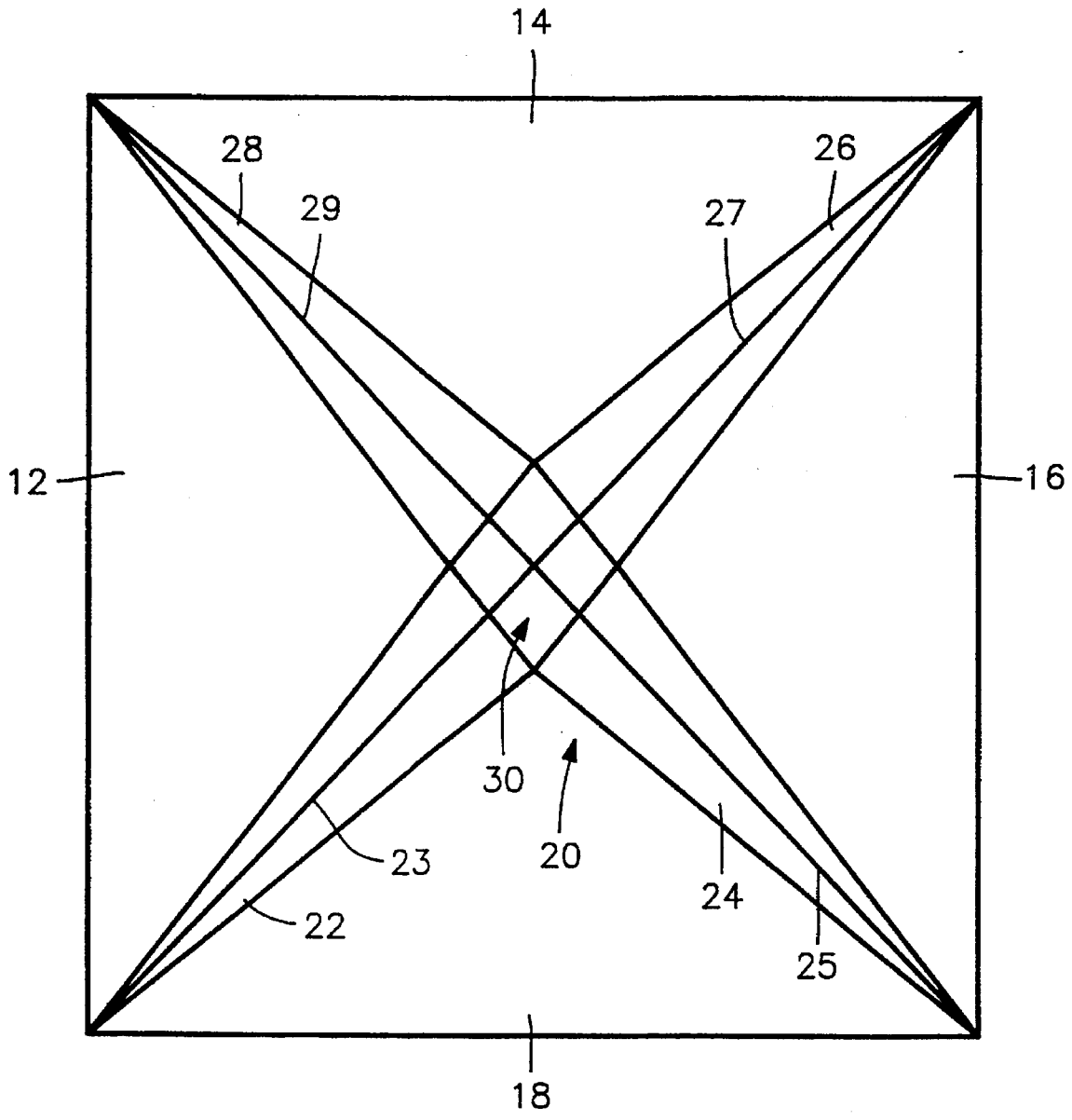
FIG. 2 shows a top view of the diamond according to FIG. 1.
Figure 3A:
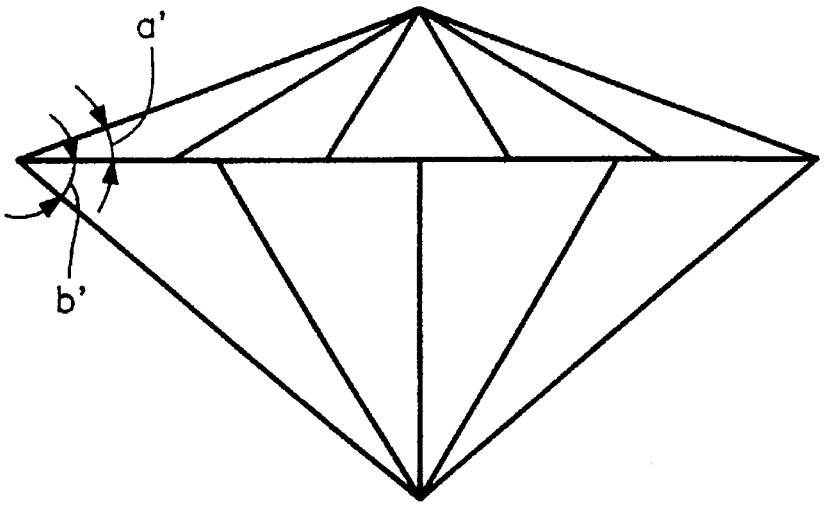
FIG. 3A shows a side view of a cut diamond having eight facets in the upper and lower parts.
Figure 3B:
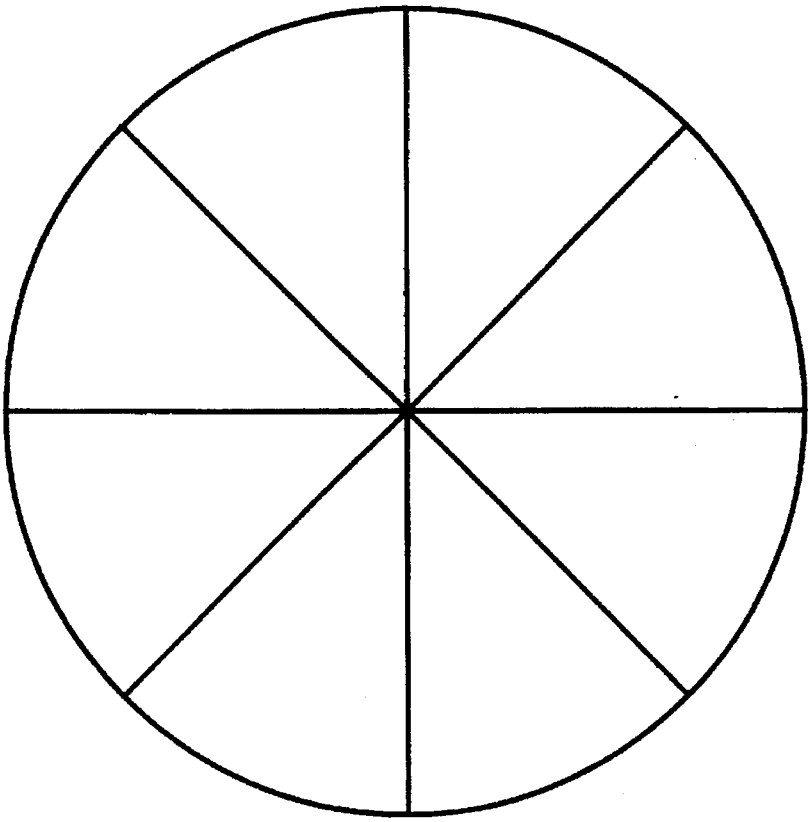
FIG. 3B is a bottom view of the cut diamond of FIG. 3A.
Figure 4A:
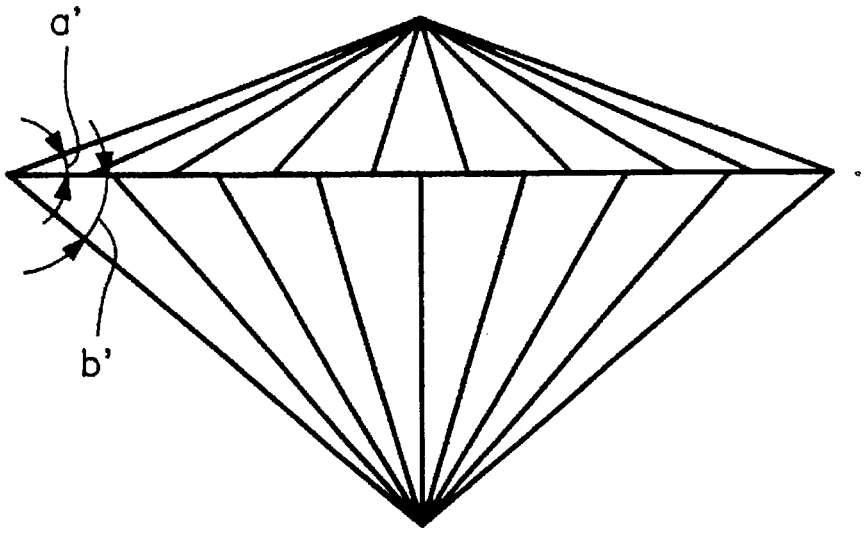
FIG. 4A shows a side view of a cut diamond having sixteen facets in the upper and lower parts.
Figure 4B:
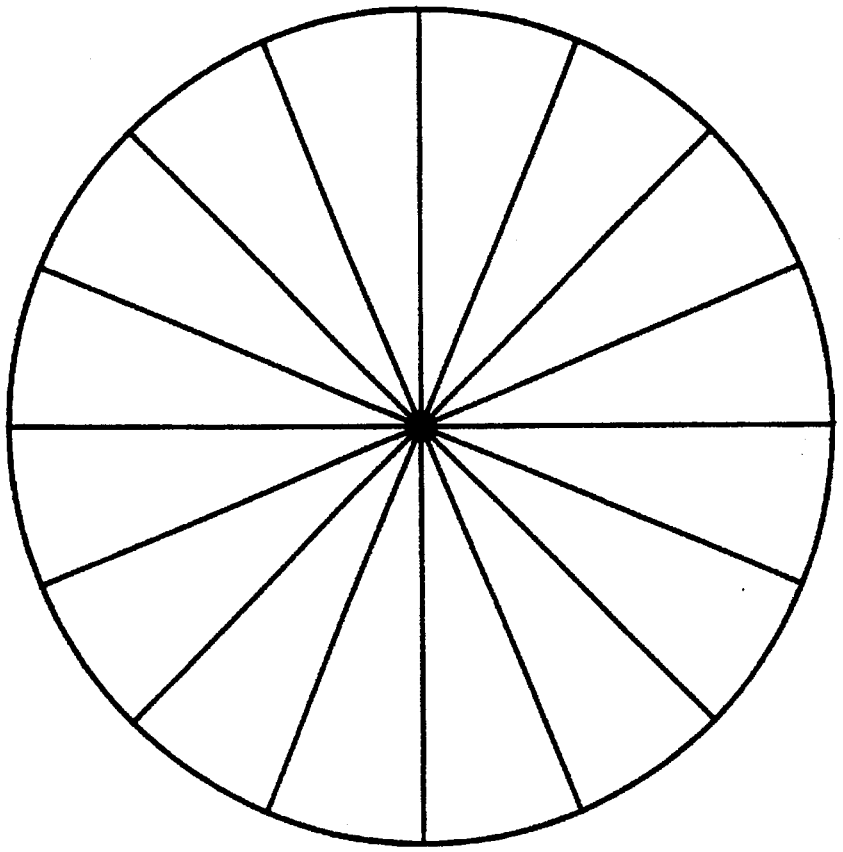
FIG. 4B is a bottom view of the cut diamond of FIG. 4A.

In the diamond according to FIG. 1 and 2, the upper part 2 of the diamond rises above the square level 1. This upper part consists of four equally large facets tapering to a culet 3. Each facet, such as facet 4, for example, forms an equal-sided triangle.

The lower part 5 of the diamond also consists of four equally large facets that taper to the lower culet 6. Each facet of the lower part 5, facet 7, for example, forms an equal-sided triangle, in such a way that culets 3 and 6 are situated on a center line vertical to the girdle level of the diamond.

The angle a between facet 4 of the upper part and the girdle level 1 is 24.5 degrees and angle b between facet 7 of the lower part and the girdle level is 39.5 degrees.

When looking down on the upper part, the above described diamond appears, according to FIG. 2, to consist of four equally large, equal-sided triangles 12, 14, 16, 18 each going out from a lateral angle of a square, and each of plane, uniform brilliance and separated from each other by a shining, diagonal cross 20. The cross consists of four, light, equal-sided, narrow triangles 22, 24, 26, 28, whose tips are each situated in a corner of the square and whose bases enclose a small square 30 appearing in the middle of the square. The lightness of the diagonal cross is greater than the brilliance of the triangle surfaces 12 . . . 18. Each of the four narrow triangles 22, 24, 26, 28 is penetrated by its center line 23, 25, 27, 29, whereby the center lines continue into the square 30 and divide it into four parts. The cross 20 thereby reminds one of the appearance of a four-rayed star. The appearance in FIG. 2 is remarkable by the total lack of coloring of white light striking the diamond.

FIGS. 3A, 3B and 4A, 4B illustrate a similar cut diamond of eight and sixteen facets respectively in the upper and lower parts whereby the facets of the upper part enclose an angle a' (and a") of approximately 20.5 degrees and the facets of the lower part enclose an angle b' (and b") of approximately 40 degrees, with respect to the girdle level.

Having described the invention, many modifications thereto will become apparent to those skilled in the art to which it pertains without deviation from the spirit of the invention as defined by the scope of the appended claims.

I claim:

1. A diamond cut without a plate or table having an upper part (or crown), a lower part (or pavilion) and a girdle defining the boundary between the upper part and lower part, said upper part including between eight and sixteen upper facets, each upper facet tapering to a culet of the upper part, said lower part including between eight and sixteen lower facets, each lower facet tapering to a culet of the lower part, wherein each of said upper and lower facets are planar triangular facets, and wherein the angle between each of the upper facets and the girdle is substantially 20.5° and the angle between each of the lower facets and the girdle is substantially 40°, and wherein said upper part and said lower part are completely solid and free of any openings or insertions, such that, when viewed from above the top of the upper part looking down toward the girdle, the girdle level appears as a planar brilliant shining star.

2. The diamond according to claim 1, wherein the upper facets and the lower facets meet each other at the girdle forming a symmetrical off-set structure such that one edge of each upper facet meets the imaginary center line of each lower facet.

* * * * *